United States Patent [19]

Larsen

[11] 4,270,705

[45] Jun. 2, 1981

[54] SHELL LINER ASSEMBLY FOR ORE GRINDING MILLS

[75] Inventor: Darrell R. Larsen, Salt Lake City, Utah

[73] Assignee: Minneapolis Electric Steel Castings Company, Minneapolis, Minn.

[21] Appl. No.: 79,382

[22] Filed: Sep. 27, 1979

Related U.S. Application Data

[63] Continuation-in-part of Ser. No. 932,711, Aug. 11, 1978.

[51] Int. Cl.[3] ..... B02C 17/22

[52] U.S. Cl. ..... 241/183; 241/182; 241/299

[58] Field of Search ..... 241/182, 183, 284, 299

[56] References Cited

U.S. PATENT DOCUMENTS

| | | | |
|---|---|---|---|
| 887,575 | 5/1908 | Barry | 241/182 |
| 1,055,395 | 3/1913 | Globe | 241/183 |
| 1,128,901 | 2/1915 | Posselt | 241/183 |
| 1,295,289 | 2/1919 | Fasting | 241/183 |
| 1,315,025 | 9/1919 | Lawler | 241/183 |
| 1,470,420 | 10/1923 | Askin et al. | 241/183 |
| 1,534,000 | 4/1925 | Baker | 241/183 |
| 1,807,034 | 5/1931 | Hardinge | 241/183 |
| 1,872,036 | 8/1932 | Hardinge | 241/70 |
| 2,216,784 | 10/1940 | Payne | 241/182 X |
| 3,065,920 | 11/1962 | Johnson et al. | 241/182 X |
| 3,404,846 | 10/1968 | MacPherson et al. | 241/183 X |
| 3,462,090 | 8/1969 | Landes et al. | 241/299 |
| 3,582,007 | 6/1971 | Heighberger | 241/183 |
| 3,630,459 | 12/1971 | Slegten | 241/183 |
| 3,680,799 | 8/1972 | Hallerback | 241/183 |
| 3,701,487 | 10/1972 | Quesnel et al. | 241/183 |
| 3,804,346 | 4/1974 | Norman | 241/182 |
| 3,949,943 | 4/1976 | Schuler et al. | 241/183 |
| 4,018,393 | 4/1977 | Larsen | 241/182 |
| 4,046,326 | 9/1977 | Larsen | 241/182 |
| 4,165,041 | 8/1979 | Larsen | 241/182 |

FOREIGN PATENT DOCUMENTS

| | | |
|---|---|---|
| 1131489 | 10/1959 | Fed. Rep. of Germany . |
| 2305311 | 3/1973 | Fed. Rep. of Germany . |
| 474388 | 3/1967 | Japan . |

*Primary Examiner*—Richard B. Lazarus

*Attorney, Agent, or Firm*—Merchant, Gould, Smith, Edell, Welter & Schmidt

[57] ABSTRACT

The disclosure is directed to an improved liner assembly for the drum or shell of an ore grinding machine, comprising a first plurality of liner segments mounted directly to the shell and a second plurality of segments each of which is secured to one of the first segments independently of the shell. In the claimed embodiment, each of the first segments defines a longitudinal, axially extending channel that opens toward the center of the shell and has opposed inner surfaces that converge toward the shell center. The first segments are secured to the shell by nut and bolt assemblies that extend through the segment from the bottom of the channel and through the shell. The second segments are constructed for lengthwise insertion into the channel, and each has converging sides conforming to the channel sides for retention therein, while at the same time protectively overlying the nut and bolt assemblies during the grinding process.

21 Claims, 10 Drawing Figures

SHELL LINER ASSEMBLY FOR ORE GRINDING MILLS

This is a Continuation-in-Part of my copending application filed on Aug. 11, 1978 under Ser. No. 932,711, entitled "Shell Liner Assembly for Ore Grinding Mills".

The invention relates generally to apparatus for comminuting ore, and is specifically directed to an improved liner assembly for an ore grinding mill used in commercial mining operations.

Grinding mills of this type may employ rods or balls to assist in the comminuting process as the mill is rotated, or the ore may be self-grinding in large automatic mills. An example of the latter type mill consists of a large cylindrical drum mounted on bearings for rotation about a substantially horizontal axis and driven by a powerful motor through conventional reduction gearing. The axial ends of the drum are open, and the material to be comminuted is continuously fed into the mill at one end with the comminuted product continuously emerging from the other end.

From the economic standpoint, it is important to keep any type of ore grinding mill in operation as continuously as possible, keeping the downtime for maintenance or repair to a minimum. However, many ores (e.g., taconite) are extremely hard and highly abrasive, and in order to maintain continuous operation of the grinding mill it is necessary to provide a liner for the drum which is highly abrasion resistant, and also tough enough to withstand the continuous impact of the ore fragments.

Due to size and weight considerations, liner assemblies for ore grinding mills of this type are typically segmented; i.e., they comprise a plurality of separate components that are individually secured to the drum of shell of the mill. My earlier U.S. Pat. No. 4,018,393 is directed to liner segments which are formed with sockets of a special shape and disposed at predetermined intervals, and which are held within the cylindrical shell by bolts having heads received in the sockets and threaded shanks passing through the liner segments and the mill shell to receive nuts at the outer surface. The sockets and heads are shaped to provide continuous flat contact areas of substantial size regardless of variations in center distances of holes axially along the shell.

This particular approach to securing the segment and liners to the shell has represented a signficant improvement due to previous difficulties in obtaining registration of bolt holes in the segments and shell, and continuous flush engagement of contiguous surfaces. However, as was recognized in my later issued U.S. Pat. No. 4,046,326, the structural configuration of liner segments is necessarily complex, and does not lend itself to fabrication from materials which are highly abrasion resistant. Examples of ideal materials for this use are martensitic white iron or martensitic steel, both of which are extremely abrasion resistant. However, since materials such as these undergo a significant volume change as they pass from the austenitic stage to martensitic form, it is extremely difficult to form from such materials an article of significant size or complex configuration since the transformation from martensite, as the result of rapid cooling, may crack the article and render it useless in an ore crushing operation. Thus, prior to the invention disclosed and claimed in U.S. Pat. No. 4,046,326, segmented liners were usually made from a "tough" material which offered relatively good resistance to impact, although its resistance to abrasion was somewhat lower. My later patent was, therefore, directed to a liner assembly in which the primary structure of each liner segment is made from a "tough" material, coupled with the use of one or more inserts formed from highly abrasion resistant material in a manner such that the insert or inserts represent primary exposure to the ore fragments but are always retained, even if they break due to brittleness. This is accomplished through the formation of an opening extending entirely through the liner assembly, and which has tapered sides converging toward the exposed surface. The inserts are of conforming shape and size, having similar converging sides which engage and wedge against those of the segment opening. The inserts are placed into the segment opening from its back or unexposed side, projecting through to the exposed surface but being retained in this position by the wedging action. As the liner segment is bolted to the shell, the inserts are positively and rigidly retained, capable of comminuting the ore, but incapable of escape. With such an assembly, the inserts can be made in fairly simple configurations, to overcome the fabrication problem mentioned above, and thus enabling the benefits of abrasion resistant materials.

The use of hardened inserts substantially increases the life of the liner assembly, and as a result reduces the mill downtime encountered with previous liner assemblies that wore down more quickly and required changing more frequently. However, the changing of assemblies itself remains an arduous task, and a substantial number of man hours is required. This is due primarily to the manner of connecting the liner segments to the shell, which as described above, typically involves elongated bolts that pass entirely through each of the liner segments in the shell, with threaded nuts locking the segments from the outer shell surface. Accordingly, two teams of workers are required both in removing the worn liner assembly and in installing the new assembly, one team working within the drum and one outside. The problem is compounded by the substantial size and weight of each liner segment, and the damage to the segments and connecting bolts by the continuous impact of the ore fragments during the comminution process.

The subject process is thus directed to an improved liner assembly for ore grinding mills which is easily replaceable, while at the same time preserving the substantial benefit derived from the use of abrasion resistant inserts. More specifically, the improved assembly comprises a plurality of holder segments formed from tough, impact resistant material which are fastened directly to the shell in a conventional manner. The assembly further comprises a second plurality of liner segments formed from abrasion resistant material which "cap" the holder segment, and are uniquely connected directly thereto without any mounting connection to the shell itself. In both of the preferred embodiments, provision is made for protecting the fastening means from the ore fragments so that, even if the liner is substantially worn, there is less difficulty in removing the abrasion resistant caps.

In one embodiment, the abrasion resistant cap overlies the top of the holder, as well as the side exposed to the ore fragments as they tumble with rotation of the drum. The connector comprises a heavy bolt which is in substantial alignment with the shell surface. The head of the bolt is recessed within the abrasion resistant cap, and the locking nut is protected by a protective nose formed in the cap.

In an alternative embodiment, the entire abrasion resistant cap rests on the holder, and a tongue and groove relationship between the two resists shear forces imparted by the tumbling ore fragments. The cap fastener comprises a bolt disposed transversely of the drum surface, the head of which is recessed within the cap for protective purposes. A threaded insert captively held in a recess within the holder permits the connecting bolt to be drawn down tightly, clamping the components together.

In another alternative embodiment, the first liner segments define a longitudinal, axially extending channel that opens toward the center of the shell. The channel has opposed inner surfaces that converge toward the center of the shell. The first segments are secured directly to the shell, by nut and bolt assemblies that extend through the segment from the bottom of the channel and through the shell. The second or wear segments are constructed to slide into the channel, having converging sides that are retained by the converging channel sides. The wear segments are longitudinally retained by transverse nut and bolt assemblies, or by epoxying the wear segment within the channel. The wear segments thus protectively overlie the nut and bolt assemblies that secure the first segment to the shell, avoiding damage to the nut and bolt during the combination process, and ensuring that the bolt is easily removable when liner replacement is necessary.

DESCRIPTION OF THE PREFERRED EMBODIMENT

FIGS. 1–5 disclose a segmented liner assembly according to the invention and adapted for use with a cylindrical drum or shell 11 of an ore grinding machine. The ore grinding machine may be of the type disclosed in U.S. Pat. No. 4,046,326, in which the hollow cylindrical drum or shell 11 is constructed and arranged for rotation about a substantially horizontal axis. The drum or shell 11 is substantially closed by axial end walls with the exception of central axial openings through which the ore is respectively supplied and discharged.

Figure 3:
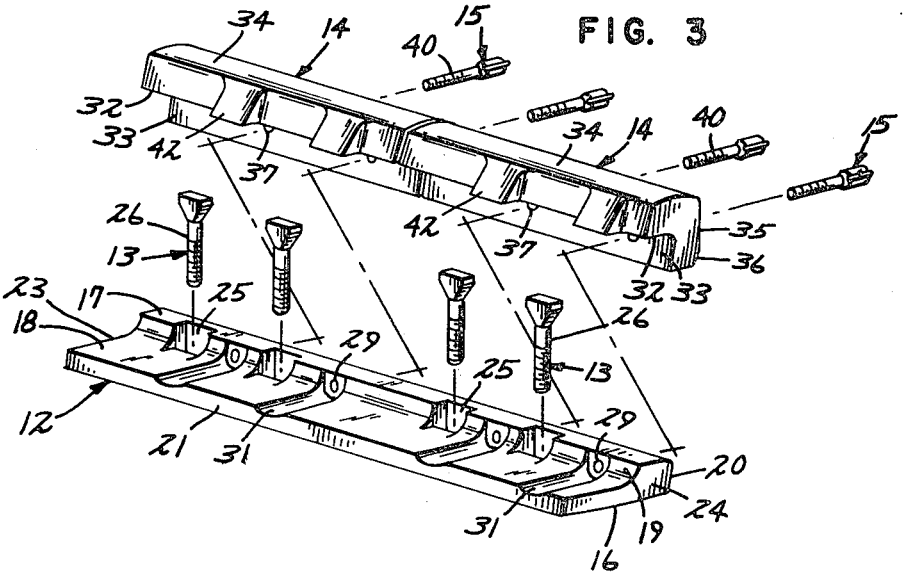
FIG. 3 is an exploded perspective view of the liner assembly components.
Figure 4:
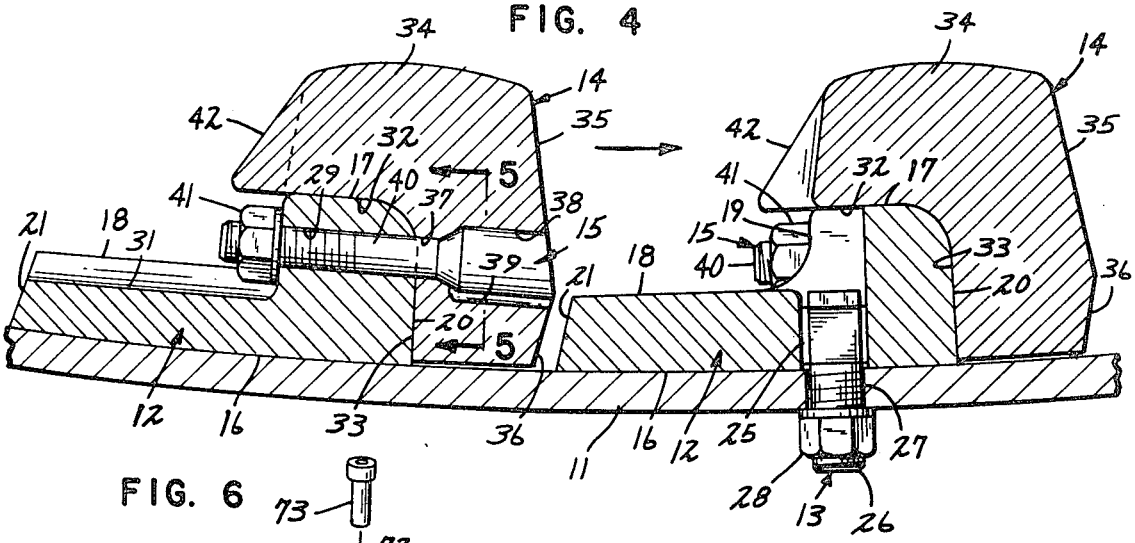
FIG. 4 is an enlarged fragmentary sectional view taken along the line 4—4 of FIG. 1.

With specific reference to FIG. 4, the liner assembly comprises a plurality of holder segments 12 fastened directly to the shell 11 by first fastening means 13, and a plurality of capped segments 14 which are secured only to the holder segments 12 by second fastening means 15. As shown in FIG. 3, both the holder segments 12 and cap segments 14 are elongated in shape, but in the preferred embodiment, two cap segments 14 are provided for each of the holder segments 12.

Figure 1:
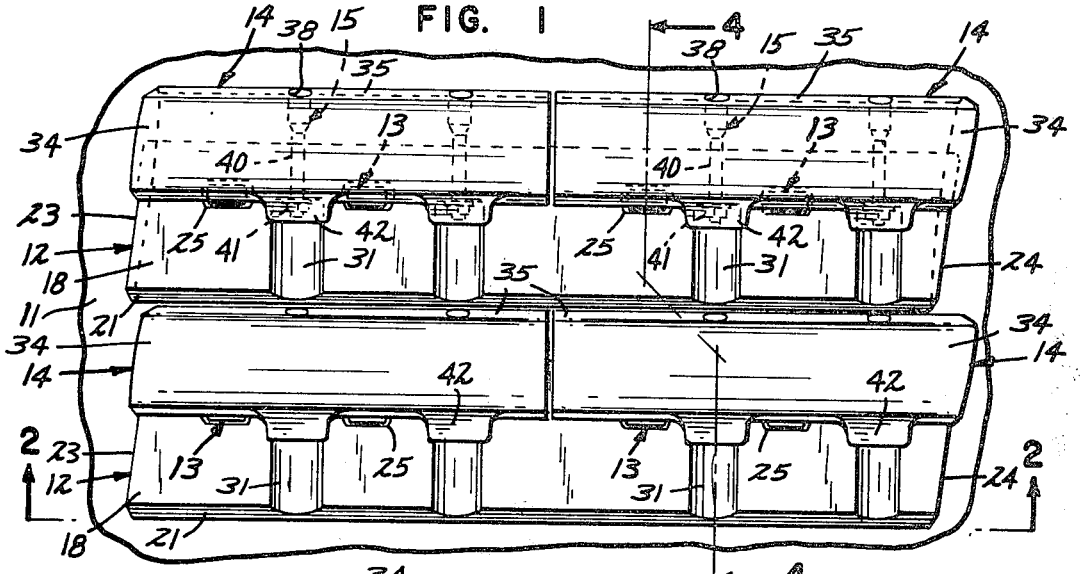
FIG. 1 is a fragmentary plan view of a segmented liner assembly for an ore grinding mill according to the invention, and viewed radially outward from within the mill.

As shown in FIG. 1, the segments 12, 14 are arranged in a plurality of rows which are substantially parallel with the axis of rotation of the shell 11, the rows being disposed in close proximity to substantially cover the inner cylindrical surface of shell 11. The shell 11 is rotated in the direction indicated in FIG. 4, and since the segment and liner assembly is of irregular contour, the ore fragments are carried upward with rotation of the drum and then tumble downward in a comminuting manner.

With reference to FIG. 4, each of the holder segments 12 defines a slightly arcuate mounting surface 16 which conforms to the inner cylindrical surface of the shell 11. The top surface of each holder segment 12 is stepped, defining a flat upper surface 17 and a flat lower surface 18 interconnected by a transverse wall 19 that is rounded at its juncture with each of the surfaces 17, 18.

Each of the holder segments 12 has a leading or forward edge 20 that is transverse to the surfaces 16, 17, and preferably substantially perpendicular thereto. The juncture of the surfaces 17 and 20 is rounded as shown. The surfaces 17, 20 together define a mounting surface for the holder segment 12, as will be discussed below.

Each holder segment 12 further defines a rear or trailing edge 21 which is slightly beveled for the purpose described below.

Figure 2:
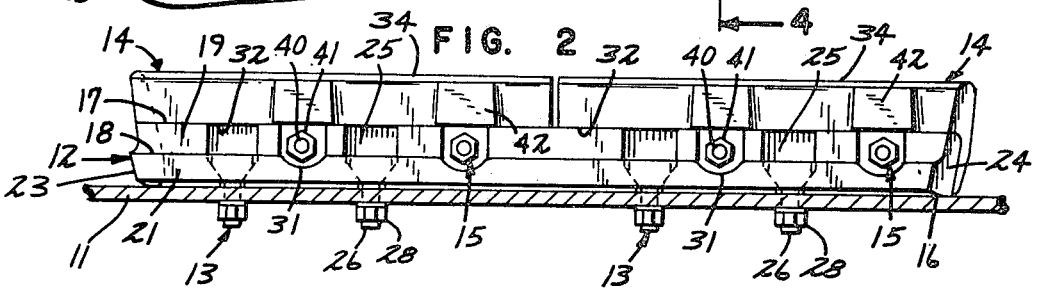
FIG. 2 is a fragmentary sectional view of the liner assembly taken along the line 2—2 of FIG. 1.

As shown in FIGS. 1 and 2, the holder segment 12 has sides 23, 24 which are angled from the leading edge 20 to the trailing edge 21, so that its overall configuration is generally trapezoidal. In addition, the sides 23, 24 converge slightly from top to bottom (i.e., toward the shell 11). This creates a recess with the side of an adjacent holder segment 12 which is generally wedge-shaped, with the larger base dimension of the recess located at the shell surface. This simplifies removal of the holder segment if necessary, even if the recess has become filled with solidified particulate matter. The side walls 23, 24, being inclined relative to such particulate matter, can be lifted out easily.

With reference to FIGS. 1–4, each of the holder segments 12 has a plurality of apertures 25 formed therethrough to receive the fastening means 13. As viewed in the top plan of FIG. 1, the apertures 25 are generally rectangular. As viewed in the side elevational view of FIG. 2, the apertures 25 define inclined side walls. As shown in FIGS. 3 and 4, the apertures 25 are formed through the upstanding portion of holder segment 12, and terminate at their upper end in a recess that opens laterally from the upstanding portion.

As constructed, the apertures 25 are adapted to receive the fastening means 13, each of which specifically comprises a threaded bolt 26 having a head with a first pair of opposed, tapered sides, and a second pair of flat, parallel sides. The apertures 25 can be disposed in registration with a like plurality of bores 27 formed through the shell 11. The threaded portion of the bolt 26 extends entirely through the aperture 25 and bore 27, and receives a locking nut 28 externally of the shell 11.

Reference is made to my earlier U.S. Pat. No. 4,018,393 for additional details of the structure and cooperative function of the apertures 25 and bolts 26. Each of the holder segments 12 is also formed with a plurality of bores 29 which extend entirely through the upstanding portion of the holder segment in substantially parallel relation with the surfaces 16–18.

As shown in FIGS. 1, 3 and 4, a plurality of shallow grooves 31 are formed in the lower step portion of holder segment 12, each of the grooves 31 extending in substantial alignment with an associated bore 29.

With specific reference to FIG. 4, each of the cap segments 14 is substantially L-shaped in transverse cross-section, defining inner mounting surface 32, 33 which mateably conform to the surfaces 17, 20 of holder segment 12. Cap segment 14 further defines a top surface 34 which is slightly convex, and a leading surface 35 which is slightly convex, and a leading surface 35 which is slightly beveled so that the ore fragments tend to tumble radially inward and not become lodged in the space between adjacent liner segments. However, the region of the leading surface immediately adjacent the inner shell surface is beveled in the opposite direction and shown at 36. As shown in FIG. 4, the angle of surface 36 is such that it diverges slightly from the adjacent trailing surface 21 of holder segment 12, thus creating a wedge-shaped cavity to facilitate segment removal as described above.

Each of the cap segments 14 has a bore 37 and counterbore 38 extending from the leading surfaces 35, 36 to the mounting surface 33. The bores 37, 38 are sized and disposed for registration with one of the bores 29 of a holder segment 12.

Figure 5:
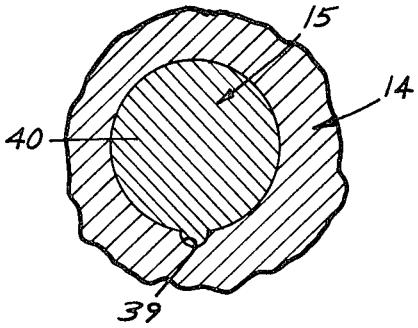
FIG. 5 is a further enlarged fragmentary sectional view taken along the line 5—5 of FIG. 4.

With references to FIGS. 4 and 5, an axially extending, semicircular groove 39 is formed adjacent the bores 37, 38 to accommodate the axial bead of a conventional "loon-head" bolt 40. Bolt 40 extends entirely through holder segment 12 and receives a locking nut 41, as best shown in FIG. 4. Because of the axial bead, the "loon-head" bolt 40 cannot rotate in the counterbore 38, enabling the cap segment 14 to be drawn tightly against the holder segment 12 by a single person with a single wrench.

With reference to FIGS. 3 and 4, cap segment 14 further comprises a "nose" 42 which protectively overlies the end of bolt 40 and nut 41.

In the preferred embodiment, the holder segments 12 are formed from tough, impact resistant material which is difficult to break and, therefore, capable of retaining the segments throughout their wearlife. The cap segments are preferably formed from material which is highly resistant to abrasion. Several materials are capable of use for both the holder segments and cap segments. Preferably, however, martensitic steel is used for both, which can be heat treated to be either tough and impact resistant, or highly resistant to abrasion. The procedures for obtaining these performance characteristics are well known in the metallurgical art. Another suitable example of an abrasion resistant material for the cap segments is martensitic white iron. Manganese steel may also be used as a tough material from which the holder segments may be formed.

As constructed, the holder segments 12 are initially installed with the use of fastening means 13. This task is carried out from both inside and outside the shell 11, but it is less frequently required. Next, the cap segments 14 are installed only from within the shell 11 with the fastening means 15. As assembled, and with the direction of rotation indicated in FIG. 4, the cap segments 14 are exposed to the ore to a much greater extent than the holder segments 12. Further, because of the construction and relationship of the components, the assembly resists shear stresses which are normally imposed during the comminution process. The operation of bolts 40, which is substantially parallel with the inner drum surface, insures that the bolts are always in compression, which these axial members can withstand to a much greater degree than their resistance to shear forces.

When the cap segments 14 wear down to the point of requiring replacement, this can be accomplished from within the shell 11 and without removal of the holder segments 12. The nose member 42 assists in this regard by protecting the nuts 41, which are removed together with the "loon-head" bolts 40. New cap segments 14 can then be installed onto the existing holder segments 12.

Figure 6:
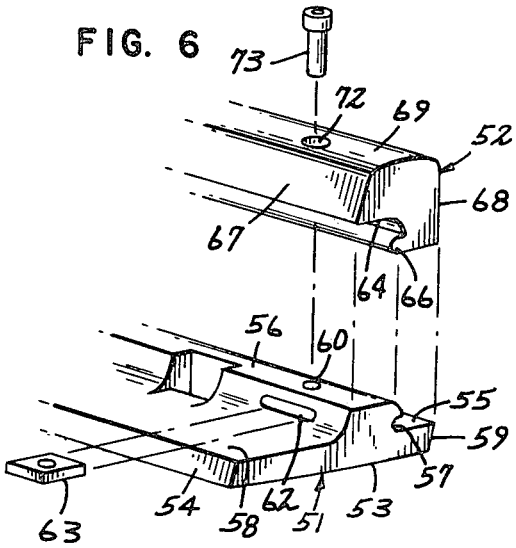
FIG. 6 is a fragmentary exploded perspective view similar to FIG. 3 of an alternative embodiment of the invention.
Figure 7:
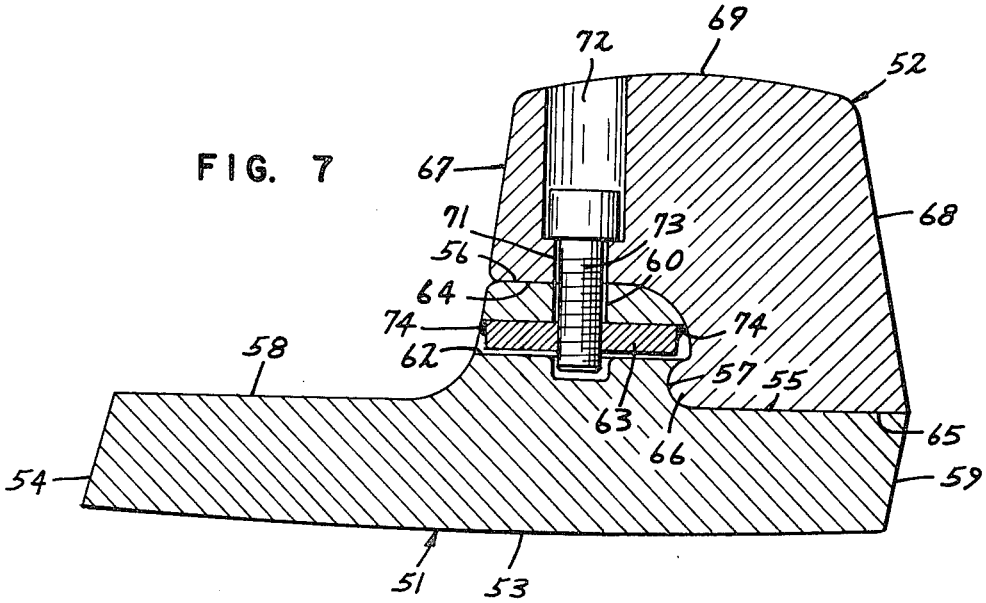
FIG. 7 is an enlarged transverse sectional view of the alternative liner assembly similar to FIG. 4.

FIGS. 6 and 7 disclose an alternative embodiment of the invention. The alternative assembly comprises a plurality of holder segments 51 and a plurality of cap segments 52. Each of the holder segments comprises a similar bottom mounting surface 53 and trailing side 54. However, the holder segments 51 support the cap segments 53 in their entirety, and accordingly include a lower stepped mounting surface 55 and a higher stepped mounting surface 56. Surfaces 55, 56 are interconnected by an irregular surface including a longitudinal groove 57.

Holder segment 51 further comprises a top surface 58 at substantially the same level of surface 55, but which does not support any part of the cap segment 53. A leading surface 59 for the holder segment 52 is similar in construction to the surface 36 of cap segment 14.

A plurality of blind bores 60 are formed through the upper mounting surface 56. A slot 62 traverses the bore 60 and is adapted to receive a square nut 63.

Each of the cap segments 52 is constructed to mateably conform to a holder segment 51. To this end, the cap segment 52 has a flat intermounting surface 64 conforming to the surface 56, a lower stepped surface 65 conforming to the surface 55, and an irregular connecting surface including a tongue 66 that fits into the groove 57.

The outer ore grinding surfaces of the cap segments 52 comprise diverging side surfaces 67, 68, interconnected by a top surface 69 which is slightly convex.

A perpendicular bore 71 and larger counterbore 72 extend through the cap segment 52 from the top surface 69 to the inner mounting surface 64. The bores 71, 72 are adapted to receive a socket head cap screw 73, which is sufficiently long to fit into the blind bore 60 for threadable engagement with the square nut 63.

Preferably, the square nut 63 is spot welded in place within the transverse slot 62, as indicated at 74. This is best accomplished by a preliminary assembly of the components, which insures proper registration of the nut 63 with the socket head screw 73 during later installation.

The tongue and groove configuration resists shear forces imposed on the assembly, and effectively insulates the cap screw 73 from such forces. The longitudinal tongue and groove also provide excellent retention and strength between the segments 51, 52 over their length.

The embodiment of FIGS. 6 and 7 offers the further advantage of using less metal in the cap segment, which wears away more quickly notwithstanding its abrasion resistance. This represents a considerable saving in material in view of the relatively frequent liner changes necessitated by worn components.

Figure 8:
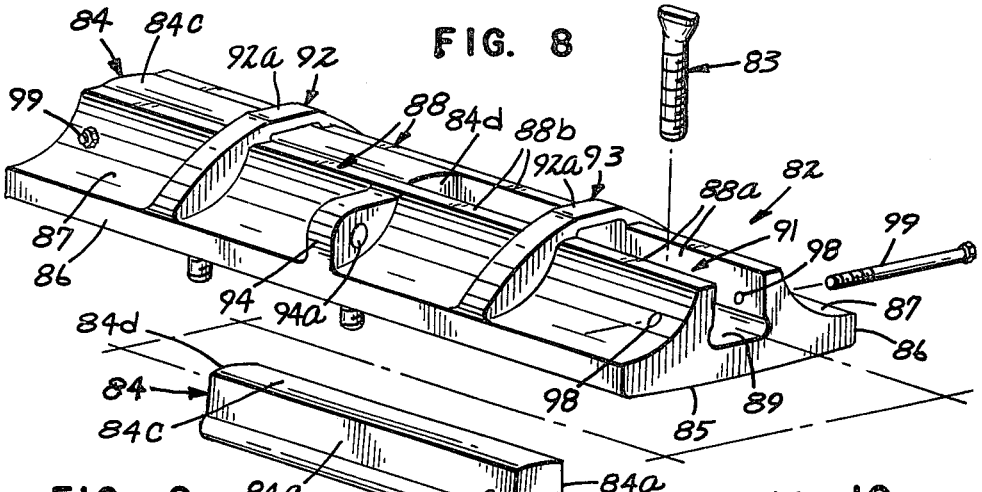
FIG. 8 is an exploded perspective view of a holder segment and a plurality of wear segments of another alternative embodiment of the invention.
Figure 9:
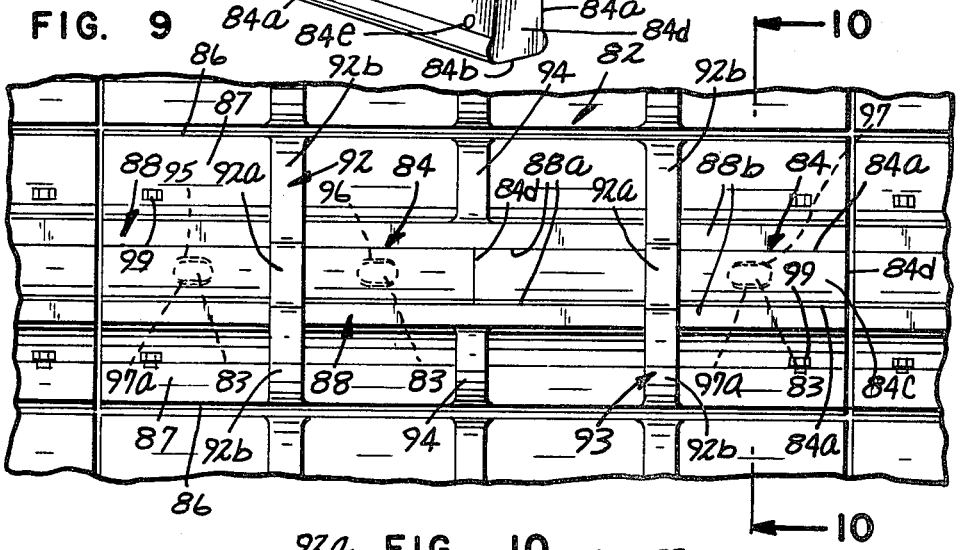
FIG. 9 is a fragmentary view in top plan of several of the holder segments and wear segments of FIG. 8 forming a liner assembly.
Figure 10:
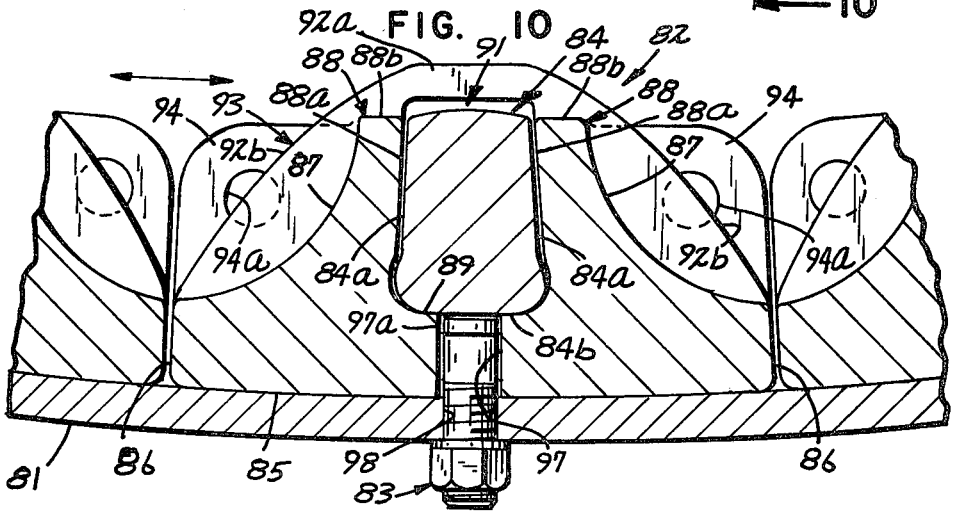
FIG. 10 is an enlarged fragmentary transverse section of the holder segment and wear segments secured to the cylindrical shell of an ore grinding machine, the sectional view being taken along the line 3—3 of FIG. 2.

FIGS. 8–10 disclose another alternative embodiment of a liner assembly constructed for use with a cylindrical drum 81. The liner assembly comprises a plurality of holder segments 82 fastened directly to the shell 81 by nut and bolt assemblies 83, described more fully below, and a plurality of wear segments 84. Both the holder segments 82 and wear segments 84 are generally elongated. As shown in FIGS. 1 and 2, the preferred embodiment includes two wear segments 84 for each of the holder segments 82.

As shown in FIGS. 2 and 3, the segments 82, 84 are arranged in a plurality of axial rows, which are substantially parallel with the axis of rotation of the shell 81, and a plurality of circumferential rows, the axial and circumferential rows being disposed in close proximity to substantially cover the inner cylindrical surface of shell 81. The shell 81 may be rotated in either direction as indicated by the arrow in FIG. 10, and the irregular contour of the segmented liner assembly causes the ore fragments to be carried upward with rotation of the drum, where they are dropped and tumbled downward in a comminuting manner.

With specific reference to FIG. 10, each of the holder segments 82 defines a mounting surface 85 which is slightly convex to conform to the concave inner cylindrical surface of the shell 81. Each holder segment 82 also defines longitudinal sides 86 that are substantially perpendicular to the mounting surface 85.

The comminuting surface of each holder segment 82 is symmetrical in transverse cross section, as shown in FIG. 10. The comminuting surface comprises longitudinal concave surfaces 87 which extend from the sides 86 inwardly and upwardly, each in part defining an upstanding longitudinal wall 88. The longitudinal walls 88 have inner faces 88*a* disposed in mutual opposition, and converging toward the center of the drum or shell 81.

Conversely, the faces 88*a* diverge toward the mounting surface 85, but terminate short thereof in a bottom wall 89 that defines a smooth, slightly enlarged bottom socket. As constructed, the inner faces 88*a* and bottom 89 together define a longitudinal channel 91 extending from one end of the holder segment 82 to the other, and opening inwardly toward the drum center.

The longitudinal side walls 88 are of identical height, and terminate in top surfaces 88*b* which are flat and substantially coplanar.

Each of the holder segments 82 further comprises two transverse bridge members 92, 93 which, relative to the axial length of the segment 82, are uniformly and symmetrically spaced on opposite sides of a pair of hooking members 94.

Transverse bridge members 92, 93 are identical and a description of bridge member 92 is for both. With reference to FIG. 10, bridge member 92 comprises a generally arcuate reinforcement that extends from one side 86 to the other, bridging the channel 91. The bridge member 92 is integrally formed with the concave surfaces 87 and top surfaces 88*b*, leading to a central spanning member 92*a* that has a substantially flat top. Between the spanning member 92*a* and the sides 86, the bridge member 82 defines arcuate symmetrical surfaces 92*b*.

As constructed, the bridge members 92, 93 provide reinforcement of the upstanding longitudinal walls 88, and the spanning members (e.g., 92*a*), serve to maintain proper alignment and spacing of the inner faces 88*a* during the casting process. This insures that the wear segments 84 will fit properly into the longitudinal channel 91.

With reference to FIGS. 8 and 10, each of the hooking members 94 also serves as a reinforcement, and is integrally formed with the associated concave surface 87. The hooking members 94 are disposed in transverse, symmetrical opposition, and each is formed with a large bore 94*a*, which may be used for lifting the holder segment 82 by a crane or the like during mounting of the liner assembly.

With reference to FIG. 9, each of the holder segments 82 includes three mounting openings 95–97, which are identical in configuration but nonuniformly spaced over the axial length of the holder segment 82. The mounting openings 95–97 are disposed within the channel 91, extending from the bottom 89 to the mounting surface 85 (see also FIG. 10).

Although the mounting openings 95–97 are nonuniformly spaced, they are identical in configuration, and a description of opening 97 as seen in FIGS. 9 and 10 will be exemplary. The opening 97 comprises a transverse bore having a countersunk recess 97*a* that is rounded and generally oblong when viewed in FIG. 9. The longer internal side walls of the mounting opening 97 are disposed in opposed, parallel relation (FIG. 10), whereas the rounded end walls converge toward the mounting surface 85 (not shown) to permit a wedging relation with the bolt head of the assembly.

With references to FIGS. 8 and 10, the bolt of the assembly 83 has a generally rounded, oblong head with parallel side faces and converging, rounded ends to conform to the recess 97*a* in wedging relation. Because the bolt head and countersunk recess 97*a* are oblong, the bolt cannot be rotated upon insertion. Further, the underside of the bolt head is tapered, and its insertion through the mounting opening 97 and a registering mounting opening 98 in the drum 81 enable it to tightly draw the holder segment 82 against the drum 81 in wedging relation as the nut of the assembly 83 is tightened. This is best shown in FIG. 10.

In the preferred embodiment, two wear segments 84 are provided for each holder segment 82, taking up the entire length of the holder segment channel 91. Each wear segment 84 comprises a solid, elongated member having side surfaces 84*a* that taper in conformance to the longitudinal faces 88*a* of side walls 88.

Wear segment 84 has a bottom surface 84*b* that corresponds in configuration to the bottom 89 of the longitudinal channel 91 of holder segment 82. This bottom region has slightly enlarged, rounded sides, giving it a slightly bulbous shape that conforms to the slightly enlarged bottom socket of longitudinal socket 91.

Each wear segment 84 has a very slightly rounded top surface 84*c*, and its overall height is such that the surface 84*c* projects very slightly above the top surfaces 84*b* of upstanding longitudinal walls 88. This dimensional relationship is not critical, but it is desirable that the wear segment 84 be at least as high as the longitudinal walls 88 to properly perform its function.

Each wear segment 84 has flat, parallel end walls 84*d* that are substantially perpendicular to its longitudinal axis. This enables the wear segments 84 to abut each other closely (FIG. 9), and thus establish a continuous wear surface over the entire length of each holder segment 82.

In the preferred embodiment, one end of each wear segment 84 is formed with a transverse bore 84*e* that is sized and positioned for registration with one of two transverse mounting bores 98 formed through the upstanding wall members 88 at each end of the holder segment 82. A nut and bolt assembly 99 secures the wear segments 84 in place as shown.

In the preferred embodiment, the holder segments 82 are formed from tough, impact-resistant material which is difficult to break, capable of retaining the wear segments 84 throughout their wear life. The wear segments 84 are preferably formed from material which is highly resistant to abrasion. Several materials are capable of use for both the holder segments 82 and wear segments 83. Preferably, however, martensitic steel is used for both, which can be heat treated to be either tough and impact-resistant, or highly resistant to abrasion. The procedures for obtaining these performance characteristics are well known in the metallurgical art.

Another suitable example of an abrasion-resistant material for the wear segments 84 is martensitic white iron. Manganese steel may also be used as a impact-resistant, tough material from which the holder segments may be formed.

As constructed, the holder segments 82 are initially installed with the use of nut and bolt assemblies 83. This task is carried out from both inside and outside the shell 81, but it is less frequently required. The wear segments 84 are preferably assembled with the holder segments before this installation with the nut and bolt assemblies 99 and/or with the use of epoxy as described above, but it is also possible to install the wear segments from within the shell as each holder segment is installed.

As assembled, the top ends of upstanding longitudinal walls 88 are initially exposed to substantial wear by ore fragments as they are carried upwardly by rotation of the shell and then tumble down due to gravity. However, since the entire holder segment 82 is formed from material which wears down more quickly than that of the wear segment 84, the upper ends of the longitudinal walls 88 tend to wear away due to this exposure. As this occurs, the wear segments 84 thereafter bear the primary burden of ore fragment contact during the comminution process. Since each wear segment is formed from highly abrasion-resistant material, it wears extremely well and requires replacement far less frequently than segments formed in their entirety from materials which do not have high abrasion resistance.

With specific reference to FIG. 10, it will be noted that the symmetrical cross sectional configuration of the wear segments 82 is such that the upstanding longitudinal walls 88 are uniformly spaced from the walls 88 and wear segments 84 of adjacent holder segments 82 in each circumferential direction. This means that the cylindrical drum 11 may in fact be rotated in either direction, as shown in FIG. 10, with the same comminuting result. With the initial direction of rotation so reversed, the opposite upstanding longitudinal wall 88 is now exposed to the ore fragments as they are carried upwardly and tumbled downward. As such, reversal of the rotation of drum 81 permits a doubled wear life before replacement of the wear segments 84 or an entire liner assembly is necessary.

In either direction of rotation, it will also become apparent that the spanning members 92*a* of bridge members 92 are initially exposed to substantial wear by the ore fragments. Accordingly, these elements wear away rather quickly, which they are intended to do since their primary function is one of maintaining the aligned relationship of upstanding walls 88 during the casting process.

In addition, at the time the spanning members 92*a* wear away, they also present a continuous, axially extending wear ridge, as defined by the end-to-end wear segments 84 which run the entire axial length of the drum 81. Since the liner assembly comprises holder segments 82 and wear segments 84 disposed in axial and also circumferential rows, it will be appreciated that the comminuting surface comprises a plurality of axially extending ridges which are circumferentially spaced around the entire inner cylindrical surface of the drum 81.

The axial continuity of these comminuting ridges is important, since it obviates localized wear in softer materials which would otherwise occur. Stated otherwise, if the wear segments 84 were axially spaced with lesser resistant material disposed therebetween, this lesser resistant material would wear more quickly and form circumferential grooves or racers in the face of the liner assembly. This has a detrimental effect on the comminuting process, since uniformity of movement is lost and the ore fragments tend to congregate in the grooved areas. Accordingly, it will be appreciated that a liner assembly comprising a plurality of circumferentially spaced, continuous axial wear surfaces of abrasion-resistant material not only comminutes the ore fragments more efficiently, but also has an increased wear life.

Replacement of the holder segments 82 is enhanced because the mounting openings 95–97 are always protected by the presence of the wear segments 84. In many prior art liner assemblies, the mounting openings are continuously exposed to the ore fragments as they are comminuted. This often has the effect of distorting the mounting opening by peening. This precludes the mounting bolt of the assembly 83 from being withdrawn through the opening, and has the effect of substantially increasing the time involved in replacing the holder segments 82.

With the mounting openings 95–97 continuously protected by the wear segments 84, there is no possibility of distortion of the bolt hole opening. As such, replacement of the holder segments 82 is simplified, resulting in less down time to the operation.

What is claimed is:

1. An improved liner assembly for the shell of an ore grinding machine having a predetermined rotational axis, the liner assembly comprising:

a plurality of longitudinal holder segments having first and second ends and each defining a mounting surface constructed for mounting engagement with the inner surface of said shell, and a grinding surface;

each holder segment further defining a longitudinal channel extending from one end to the other, said longitudinal channel having a closed bottom and opening at the grinding surface, and being further defined by longitudinal sides that converge at least in part toward the grinding surface;

a plurality of mounting openings formed in each holder segment and extending from the bottom of said channel to the mounting surface of the holder segments;

connecting means passing through the mounting openings for connecting each of said holder segments directly to the shell;

a plurality of longitudinal wear inserts for the holder segments, each insert being one piece and sized for lengthwise insertion into one of the longitudinal channels and having a cross section that substantially fills the channel so that the insert protectively overlies the connecting means, and each insert further comprising longitudinal sides that converge at least in part in conformance with the channel sides so that the insert is retained within the channel independently of the shell;

the holder segments being arranged in the assembly with the longitudinal channels and wear inserts extending axially of the shell.

2. The liner assembly defined by claim 1, wherein the connector means comprises a nut and bolt assembly, the nut being securable externally of the shell.

3. The liner assembly defined by claim 2, wherein the bolt has an enlarged, oblong head, and the mounting opening defines an oblong countersunk recess for the bolt head.

4. The liner assembly defined by claim 3, wherein the bolt head has a tapered undersurface, and said countersunk recess has tapered sides conforming to the bolt head to effect a wedging relationship as the nut is drawn against the external surface of the shell.

5. The liner assembly defined by claim 1, wherein a plurality of wear inserts are provided for each holder segment, the cumulative length of said inserts approximating the length of said channel.

6. The liner assembly defined by claim 5, wherein two of said wear inserts are provided for each holder segment.

7. The liner assembly defined by claim 1, wherein the shell defines an inner cylindrical surface, and the wear inserts are mounted to the inner shell surface in axial rows.

8. The liner assembly defined by claim 7, wherein the wear inserts are further mounted to the inner shell surface in circumferential rows.

9. The liner assembly defined by claim 1, wherein the wear inserts are formed from material which has a greater resistance to abrasion than the material of said holder segments.

10. The liner assembly defined by claim 9, wherein the wear inserts are formed from martensitic white iron.

11. The liner assembly defined by claim 9, wherein the wear inserts are formed from martensitic steel.

12. The liner assembly defined by claim 9, wherein the holder segments are formed from material which has a better resistance to impact than the material of said wear inserts.

13. The liner assembly defined by claim 1, wherein the holder segments are arranged in the assembly in axial rows, and the holder segments and wear inserts are configured to define axially extending elevated ridges.

14. The liner assembly defined by claim 13, wherein the longitudinal sides of the channel extend in longitudinal, parallel relation.

15. The liner assembly defined by claim 13, wherein each of the wear segments comprises a solid transverse cross section.

16. An improved structural combination for use in a liner assembly for the shell of an ore grinding machine, comprising:

a longitudinal holder segment having first and second ends and defining a mounting surface constructed for mounting engagement with the inner surface of the shell, and a grinding surface;

the holder segment having a longitudinal channel formed therein that extends from one end to the other, said longitudinal channel having a closed bottom and opening at the grinding surface, and being further defined by longitudinal sides that converge at least in part toward the grinding surface;

a plurality of mounting openings formed in the holder segment and extending from the bottom of said channel to the mounting surface of the holder segment;

connecting means passing through the mounting openings for connecting each of said holder segments directly to the shell;

and at least one longitudinal wear insert sized for lengthwise insertion into the longitudinal channel and having a cross section that substantially fills the channel so that the insert protectively overlies the connecting means, and the insert further being one piece and comprising longitudinal sides that converge at least in part in conformance with the channel sides so that the insert is retained within the channel independently of the shell;

the wear insert being formed from a material that has a greater resistance to abrasion than the material of the holder segment.

17. The combination defined by claim 16, wherein the holder segment and wear insert are configured to together define an elevated, longitudinally extending ridge that is symmetrically disposed within a transverse cross section of the combination.

18. The combination defined by claim 17, wherein the holder segment further comprises first and second upstanding, opposed walls that extend longitudinally over its length, the longitudinal channel being defined between the opposed walls.

19. The combination defined by claim 16, wherein a plurality of wear inserts are provided for the holder segment, the cumulative length of the inserts approximating the length of the channel.

20. The combination defined by claim 16, wherein the wear segment comprises a solid transverse cross section.

21. The combination defined by claim 16, wherein the connector means comprises a nut and bolt assembly.

* * * * *